US008499439B2

(12) United States Patent
Iwamoto et al.

(10) Patent No.: US 8,499,439 B2
(45) Date of Patent: Aug. 6, 2013

(54) POSITIONING APPARATUS AND PRESSING APPARATUS

(75) Inventors: Naoki Iwamoto, Aikoh-gun (JP); Hidenori Inoue, Aikoh-gun (JP)

(73) Assignee: NHK Spring Co., Ltd., Kanagawa (JP)

( * ) Notice: Subject to any disclaimer, the term of this patent is extended or adjusted under 35 U.S.C. 154(b) by 238 days.

(21) Appl. No.: 13/155,639

(22) Filed: Jun. 8, 2011

(65) Prior Publication Data

US 2012/0011710 A1 Jan. 19, 2012

(30) Foreign Application Priority Data

Jul. 16, 2010 (JP) ..... P2010-162288

(51) Int. Cl.
*B23P 19/00* (2006.01)

(52) U.S. Cl.
USPC ..... 29/759; 29/740

(58) Field of Classification Search
USPC ..... 29/759, 740, 827, 834, 840; 72/330
See application file for complete search history.

(56) References Cited

U.S. PATENT DOCUMENTS 4,064,917 A * 12/1977 Diaz ..... 140/105
4,733,462 A * 3/1988 Kawatani ..... 29/840

FOREIGN PATENT DOCUMENTS

JP 7-052096 2/1995
JP 11-330336 11/1999

* cited by examiner

*Primary Examiner* — Thiem Phan
(74) *Attorney, Agent, or Firm* — Jordan and Hamburg LLP

(57) ABSTRACT

A positioning apparatus has a pilot holder having a hold face, a positioning pin having a tapered tip and supported by the pilot holder so that the tapered tip protrudes from the hold face of the pilot holder, a pad having a pad face that opposes the hold face of the pilot holder, and a movable member having a stop face that opposes the positioning pin and a relief hole for avoiding the tapered tip of the positioning pin from hitting the stop face, the movable member resiliently supported on the pad. The pilot holder and the pad in which the thin plate material is set between the hold face and the pad face relatively move to insert the tapered tip of the positioning pin into the positioning hole of the thin plate material. The stop face is flush with or protruding from the pad face of the pad.

4 Claims, 3 Drawing Sheets

Fig.5A

| | Lifter height (H) = 0.00mm | | Lifter height (H) = 0.09mm | | Lifter height (H) = 0.20mm | |
|---|---|---|---|---|---|---|
| | 4 pilots | 2 pilots | 4 pilots | 2 pilots | 4 pilots | 2 pilots |
| σx | 1.1 | 1.4 | 1.0 | 1.2 | 1.0 | 1.3 |
| σy | 1.0 | 0.9 | 0.8 | 1.0 | 0.9 | 1.0 |

t =0.030mm, Positioning with tapered tip and lifter support

Fig.5B

| | 2 Pilot |
|---|---|
| σx | 0.7 |
| σy | 1.2 |

t =0.100mm, Positioning with tapered tip and standard support

Fig.5C

| | 2 Pilot |
|---|---|
| σx | 2.2 |
| σy | 1.6 |

t =0.030mm, Positioning with tapered tip and standard support

POSITIONING APPARATUS AND PRESSING APPARATUS

BACKGROUND OF THE INVENTION

1. Field of the Invention

The present invention relates to a positioning apparatus to properly position a thin plate material and a pressing apparatus to properly position and press a thin plate material.

2. Description of Related Art

A hard disk drive installed in, for example, a computer has a head suspension to write and read data to and from a disk in the hard disk drive. The head suspension has a thin load beam provided with a head that is positioned at high speed to a target spot on the disk. The load beam must be light, stiff, nonmagnetic, and resilient. For this, the load beam is formed by bending, punching, and cutting a thin plate material made of stainless steel.

The load beam is made thinner year by year from 0.100 mm to 0.050 mm, 0.030 mm, 0.025 mm, and the like. Such a thin plate material is precisely bent and formed into the load beam having required functions and rigidity balance.

To produce the precision load beam, a thin plate material must accurately be positioned. For example, to provide the load beam with a dimple, which enables a slider attached to the load beam to perform gimbal motion, the thin plate material must be positioned at a center position accuracy of ±0.01 mm or smaller (Cpk>1.5) in an in-plane direction. Thereafter, the thin plate material is pressed into the load beam having the dimple.

When positioning and pressing a thin plate material, positioning pins and holes are used. Use of the positioning pins and holes puts a limit on a positioning accuracy because the positioning pin usually has a straight part that engages with the positioning hole with a clearance being left between them.

To solve this problem, there are related arts disclosed in Japanese Unexamined Patent Application Publications No. H07-52096 (hereinafter referred to as Patent Document 1) and No. H11-330336 (hereinafter referred to as Patent Document 2).

According to the related art of Patent Document 1, a plate material has a positioning hole into which a positioning pin is inserted. The positioning pin is laterally pushed with a spring, to push an inner side wall of the positioning hole when inserted in the positioning hole, thereby positioning the plate material in an in-plane direction.

When the positioning pin is inserted into the positioning hole of the plate material, a tapered front end of the positioning pin receives force from the inner side wall of the positioning hole, and therefore, the positioning pin moves against the spring. As a result, a straight part of the positioning pin enters into the positioning hole, to position the plate material in an in-plane direction.

Even if there is a clearance between the positioning pin and the positioning hole, the related art of Patent Document 1 properly positions the plate material.

This related art, however, has a risk of deforming the positioning hole with the positioning pin if the plate material is thin because the spring force acts orthogonally to the inserting direction of the positioning pin.

The related art of Patent Document 2 uses a feed pin and positioning pin, so that a tapered part of the positioning pin may engage with a positioning hole of a plate material.

The tapered part of the positioning pin manages a clearance between the positioning pin and the positioning hole, to properly position the plate material.

This related art, however, raises a problem when successively positioning a plurality of thin plate materials at a certain speed. In this condition, the tapered part of the positioning pin hits the positioning hole and deforms the same, to deteriorate positioning accuracy and hinder continuous positioning.

In this way, the related arts of Patent Documents 1 and 2 have limits in speedily and accurately positioning a thin plate material in an in-plane direction by inserting a positioning pin into a positioning hole of the thin plate material.

SUMMARY OF THE INVENTION

An object of the present invention is to provide a positioning apparatus capable of speedily and accurately positioning a thin plate material in an in-plane direction by inserting a positioning pin into a positioning hole of the thin plate material. Another object of the present invention is to provide a pressing apparatus capable of properly positioning and pressing a thin plate material.

In order to accomplish the objects, a first aspect of the present invention provides a positioning apparatus including a pilot holder having a hold face, a positioning pin having a tapered tip and supported by the pilot holder so that the tapered tip protrudes from the hold face of the pilot holder, a pad having a pad face that opposes the hold face of the pilot holder, and a movable member having a stop face that opposes the positioning pin and a relief hole for avoiding the tapered tip of the positioning pin from hitting the stop face, the movable member resiliently supported on the pad so that the movable member is vertically movable. The pilot holder and the pad in which the thin plate material is set between the hold face and the pad face relatively move to insert the tapered tip of the positioning pin into the positioning hole of the thin plate material to be engaged with the tapered tip at the position of the relief hole, thereby positioning the thin plate material in an in-plane direction. The stop face of the movable member is flush with or protruding from the pad face of the pad.

A second aspect of the present invention provides a pressing apparatus employing the positioning apparatus of the first aspect. The pressing apparatus includes an upper mold on which one of the pilot holder and pad is arranged and a lower mold on which the other of the pilot holder and pad is arranged.

According to the first aspect of the present invention, the pilot holder and pad relatively move to insert the tapered tip of the positioning pin into the positioning hole of the thin plate material to be engaged with the tapered tip at high speed. At this time, the tapered tip of the positioning pin enters the relief hole of the movable member, so that the thin plate material comes in contact with the stop face of the movable member.

At this time, the movable member resiliently retracts to buffer a shock even if the tapered tip hits the positioning hole and conducts to guide the tapered tip into the positioning hole, thereby preventing deformation of the positioning hole and quickly positioning the thin plate material in an in-plane direction.

According to the second aspect of the present invention, the pressing apparatus quickly positions the thin plate material in an in-plane direction and presses the thin plate material between the upper and lower molds.

BRIEF DESCRIPTION OF THE DRAWINGS

FIGS. 5A, 5B, and 5C are tables listing positioning variations according to the second embodiment, a first comparative example, and a second comparative example, respectively.

DETAILED DESCRIPTION OF EMBODIMENTS

Embodiments of the present invention will be explained in detail with reference to the drawings. Each embodiment precisely and speedily positions a thin plate material in an in-plane direction with the use of a movable member that is resiliently supported by a pad and has a stop face provided with a relief hole.

A positioning apparatus according to the first embodiment of the present invention will be explained with reference to FIG. 1 which is a schematic view illustrating a positioning apparatus.

Figure 1:
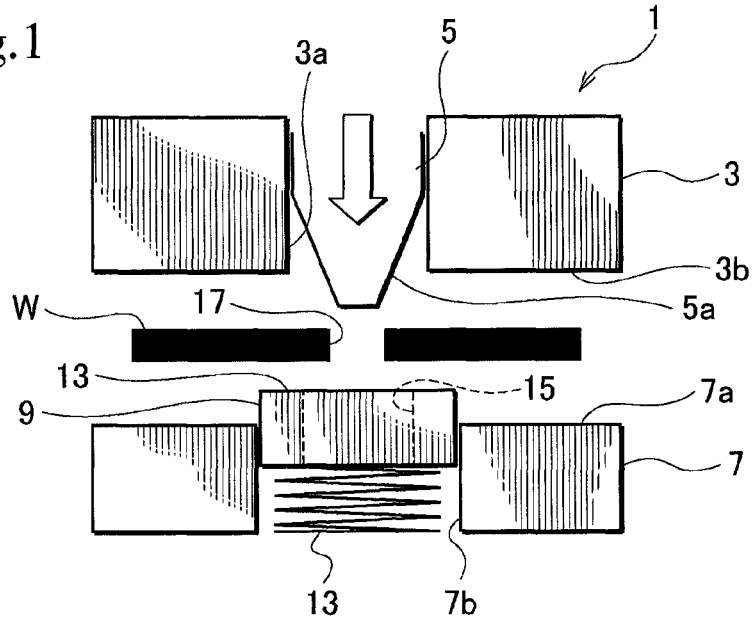
FIG. 1 is a schematic view illustrating a positioning apparatus according to a first embodiment of the present invention.

In FIG. 1, the positioning apparatus 1 has a pilot holder 3, a positioning pin 5 supported by the pilot holder 3, and a pad 7.

The pilot holder 3 has a support hole 3*a* to fixedly support the positioning pin 5. The pilot holder 3 is vertically moved with an actuator such as a hydraulic unit. The positioning pin 5 has a tapered tip 5*a* used for a positioning purpose. The tapered tip 5*a* protrudes from a hold face 3*b* of the pilot holder 3.

The pad 7 is fixedly supported by a base (not illustrated) and has a pad face 7*a* that opposes the hold face 3*b* of the pilot holder 3. The pad 7 has a support hole 7*b* having a circular section. The support hole 7*b* opposes the support hole 3*a* of the pilot holder 3.

The support hole 7*b* supports a lifter 9 as a movable member having a circular section. The lifter 9 is resiliently supported with a coil spring 11 as an elastic member on the base, and therefore, is vertically movable. The coil spring 11 has a spring force of, for example, 13 N.

The lifter 9 has a stop face 13 that opposes the positioning pin 5. The stop face 13 has a relief hole 15 that is a hollow space for avoiding the tapered tip 5*a* of the positioning pin 5 from hitting the stop face 13. In particular, the relief hole 15 receives the tapered tip 5*a* of the positioning pin 5 so that the tapered tip 5*a* may not hit the stop face 13. The relief hole 15 can be formed by a through hole that passes through the lifter 9 or a recess that does not passes through the lifter 9.

The stop face 13 of the lifter 9 is flush with or protrudes from the pad face 7*a* of the pad 7. According to the first embodiment, the stop face 13 protrudes from the pad face 7*a* by a distance greater than zero and smaller than about 90 μm.

Between the hold face 3*b* and the pad face 7*a*, a thin plate material W is placed. The thin plate material W is made of, for example, stainless steel and has a positioning hole 17 having a diameter in the range of, for example, about 0.3 mm to about 1.0 mm. The pilot holder 3 is lowered to insert the tapered tip 5*a* of the positioning pin 5 into the positioning hole 17 to be engaged with the tapered tip 5*a* at the position of the relief hole 15, thereby positioning the thin plate material W in an in-plane direction. The thin plate material W may have an optional thickness, for example, about 0.030 mm. The pilot holder 3 is descended at a speed of, for example, about 5 to 150 mm/s.

When the tapered tip 5*a* of the positioning pin 5 is inserted into the positioning hole 17 of the thin plate material W at a high relative speed, the tapered tip 5*a* is received in the relief hole 15 of the lifter 9 and the thin plate material W comes in contact with the stop face 13 of the lifter 9.

At this time, the lifter 9 instantaneously retracts against the coil spring 11. The retraction buffers a shock applied by the tapered tip 5*a* to the positioning hole 17 and centers the positioning hole 17 with respect to the tapered tip 5*a*. The thin plate material W is held between the hold face 3*b* and the pad face 7*a*.

The pilot holder 3 may be fixed to the base and the pad 7 may be arranged above the pilot holder 3. In this case, the pad 7 is vertically descended to downwardly push the thin plate material W with the pad face 7*a* and engage the positioning hole 17 of the thin plate material W with the tapered tip 5*a* of the positioning pin 5. Then, the lifter 9 quickly retracts against the coil spring 11, to buffer a shock applied by the tapered tip 5*a* to the positioning hole 17 and position the thin plate material W in an in-plane direction.

Effect of the first embodiment will be explained.

According to the first embodiment, the positioning apparatus 1 includes the positioning pin 5 having the tapered tip 5*a* and supported by the pilot holder 3 so that the tapered tip 5*a* protrudes from the hold face 3*b* of the pilot holder 3, the pad 7 having the pad face 7*a* that opposes the hold face 3*b* of the pilot holder 3, and the lifter 9 having the stop face 13 that opposes the positioning pin 5 and relief hole 15 for avoiding tapered tip 5*a* of the positioning pin 5 from hitting the stop face 13 and resiliently supported on the pad 7 with the coil spring 11 so that the lifter 9 is vertically movable. The pilot holder 3 and the pad 7 in which the thin plate W is set between the hold face 3*b* and the pad face 7*a* relatively move to insert the tapered tip 5*a* of the positioning pin 5 into the positioning hole 17 to be engaged with the tapered tip 5*a* at the position of the relief hole 15, thereby positioning the thin plate W in an in-plane direction. The stop face 13 is flush with or protrudes from the pad face 7*a* of the pad 7.

The pilot holder 3 and pad 7 are relatively moved at high speed to insert the tapered tip 5*a* of the positioning pin 5 into the positioning hole 17 to be engaged with the tapered tip 5*a*, thereby quickly and correctly positioning the thin plate material W in an in-plane direction without deforming the positioning hole 17.

Even if the stop face 13 is flush with the pad face 7*a* of the pad 7, a shock applied by the tapered tip 5*a* to the positioning hole 17 is absorbed so as to be limited within a shock that resiliently deforms the thin plate material W, to quickly position the thin plate material W in an in-plane direction.

The stop face 13 may be protruded from the pad face 7*a* by a distance greater than zero and smaller than about 90 μm, to surely buffer a shock applied by the tapered tip 5*a* to the positioning hole 17 and quickly position the thin plate material W in an in-plane direction.

A pressing apparatus according to the second embodiment of the present invention will be explained with reference to FIG. 2. The pressing apparatus of the second embodiment employs the positioning apparatus of the first embodiment, and therefore, the same or like parts are represented with the same or like reference marks to omit a repetition of explanation.

Figure 2:
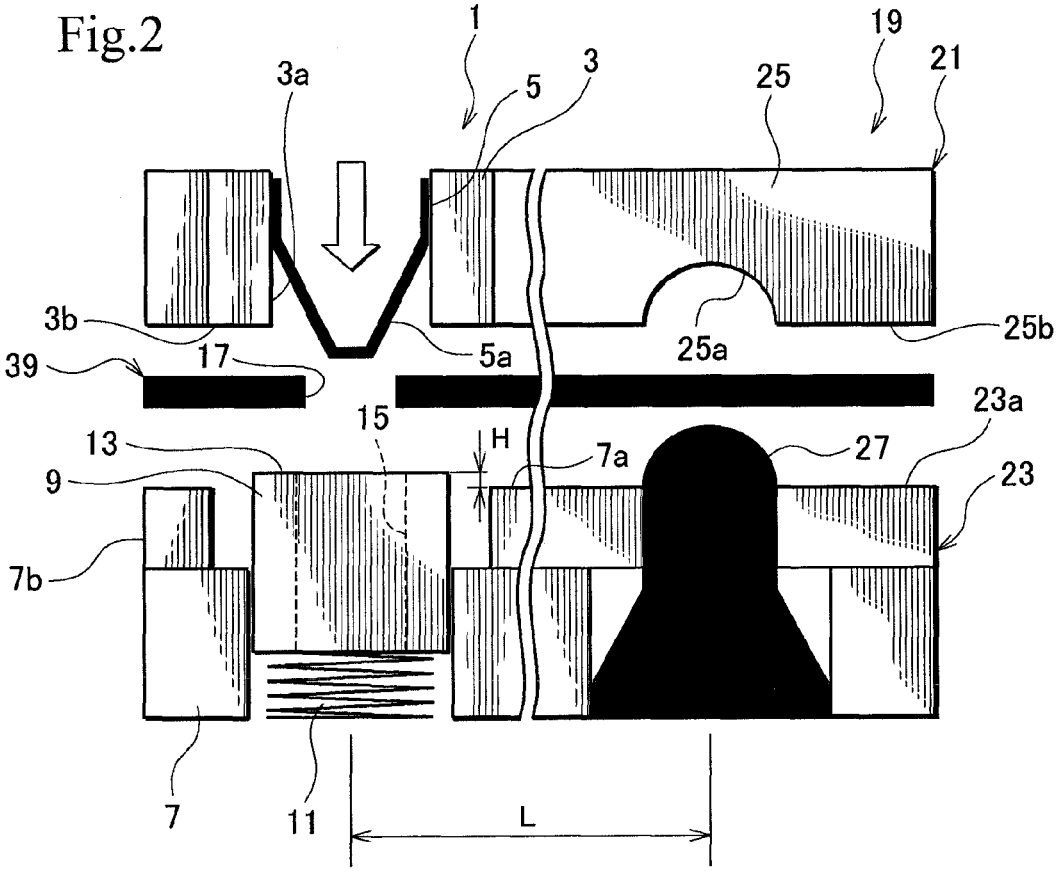
FIG. 2 is a schematic view illustrating a pressing apparatus according to a second embodiment of the present invention.

In FIG. 2, the pressing apparatus 19 according to the second embodiment employs the positioning apparatus 1 of the first embodiment. The pressing apparatus 19 has an upper mold 31 on which the pilot holder 3 is arranged and a lower mold 23 on which the pad 7 is arranged. The pad 7 has a pad block 7*b* as the upper part of the pad 7 on which the pad face 7*a* is formed. It is possible to attach the pad 7 to the upper mold 21 and the pilot holder 3 to the lower mold 23. The coil spring 11 has a spring force of 3N like the first embodiment.

The stop face 13 is protruded from the pad face 7*a* by a distance in the range of about 0 to 90 μm.

The upper mold 21 has a dimple die 25 and the lower mold 23 has a dimple punch 27. The dimple die 25 has a bottom face 25*b* that is provided with a recess 25*a* to form a dimple.

The pilot holder 3 is attached to the dimple die 25 and the pad 7 and lifter 9 are attached to the dimple punch 27. The hold face 3*b* of the pilot holder 3 is flush with the bottom face 25*b* of the dimple die 25. The pad block 7*b* of the pad 7 is integral with the lower mold 23. The pad face 7*a* is flush with a top face 23*a* of the lower mold 23.

A center distance L between a center line of the dimple die 25 and dimple punch 27 and a center line of the positioning pin 5 and pad 7 is about 20 mm. With this distance, a dimple bending process by the dimple die 25 and dimple punch 27 and a positioning process by the positioning pin 5 and pad 7 do not interfere with each other.

According to the second embodiment, the thin plate material W is a half-finished head suspension 29, i.e., a load beam of a head suspension.

Figure 3:
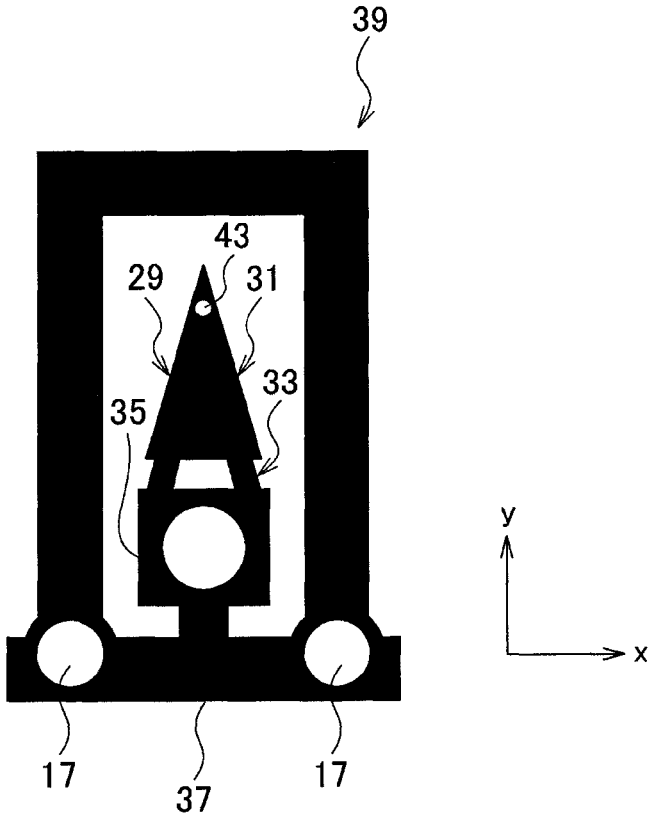
FIG. 3 is a plan view illustrating a half-finished head suspension to be positioned with two positioning holes according to the second embodiment.
Figure 4:
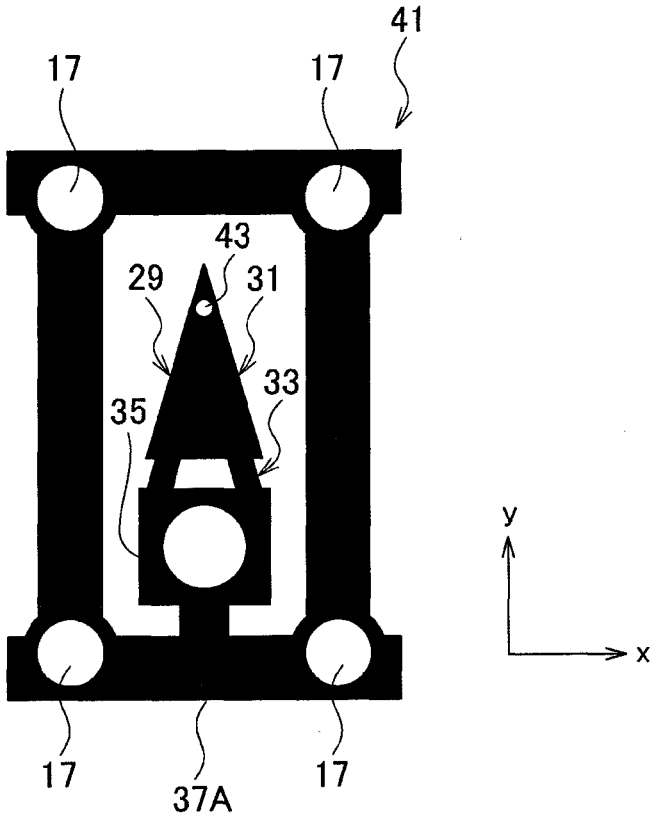
FIG. 4 is a plan view illustrating a half-finished head suspension to be positioned with four positioning holes according to the second embodiment.

FIG. 3 is a plan view illustrating the half-finished head suspension to be positioned with two positioning holes and FIG. 4 is a plan view illustrating the half-finished head suspension to be positioned with four positioning holes.

In FIGS. 3 and 4, the half-finished head suspension 29 includes a load beam part 31, a resilient part 33, and a base plate part 35. Many half-finished head suspensions 29 are chained together with a frame 37 (37A), to form a chained product 39 (41), although the chained product 39 (41) illustrated in FIGS. 3 and 4 is partial to include only one half-finished head suspension 29. The load beam part 31 has a thickness of, for example, about 0.030 mm.

The chained product 39 of FIG. 3 has two positioning holes 17 and the chained product 41 of FIG. 4 has four positioning holes 17. A distance in a feed direction (x-direction) between the positioning holes 17 is about 40 mm and a distance between the positioning hole 17 and a dimple 43 in a direction (y-direction) orthogonal to the feed direction is about 20 mm. These dimensions are only examples and any dimensions are adoptable.

Although not illustrated in FIGS. 3 and 4, two sets of the positioning pin 5, pad 7, and other related parts are arranged in the x-direction for the chained product 39 of FIG. 3 and two sets of the same are arranged in each of the x- and y-directions for the chained product 41 of FIG. 4.

Each chained product 39 (41) is intermittently fed into a space between the upper and lower molds 21 and 23, is positioned by the positioning pins 5 and positioning holes 17 as explained in the first embodiment, and is pressed by the dimple die and punch 25 and 27 to correctly form the dimple 43 on the load beam part 31. A pressing speed achieved by the upper and lower molds 21 and 23 is in the range of, for example, about 5 to 150 mm/s.

FIGS. 5A to 5C are tables listing positioning variation data, in which FIG. 5A is of the second embodiment, FIG. 5B of a first comparative example, and FIG. 5C of a second comparative example.

In FIG. 5A, the positioning variation data of the second embodiment are measured under conditions that the distance "H" (FIG. 2) between the pad face 7*a* and the stop face 13 is changed among 0.00 mm, 0.09 mm, and 0.20 mm, the number of positioning spots is changed between two (2 pilots) and four (4 pilots), and each tested load beam part 31 has a thickness "t" of 0.030 mm. Measured positioning variations are σx in the x-direction of the positioning hole 17 and σy in the y-direction of the same.

In FIG. 5B, the positioning variation data of the first comparative example are σx and σy measured at two positioning spots on each load beam part sample of 0.100 mm thick.

In FIG. 5C, the positioning variation data of the second comparative example are σx and σy measured at two positioning spots on each load beam part sample of 0.030 mm thick. The second comparative example produces many unacceptable samples and the data in the table of FIG. 5C are only of acceptable samples.

As is apparent from comparison among the second embodiment and first and second comparative examples, the second embodiment tested on thin plate samples of 0.030 mm thick provides small positioning variations σx and σy that fall within an allowable range. Consequently, the second embodiment is capable of precisely positioning a thin plate material and correctly pressing a dimple on the thin plate material.

In addition, the second embodiment provides effects that are similar to those of the first embodiment.

As mentioned above, the second embodiment is capable of quickly and continuously positioning and pressing each piece of chained thin plate materials such as load beam parts 31 without deforming the piece even it has a thickness of about 0.030 mm.

What is claimed is:

1. A positioning apparatus for a thin plate material having a positioning hole, comprising:

a pilot holder having a hold face;

a positioning pin having a tapered tip and supported by the pilot holder so that the tapered tip protrudes from the hold face of the pilot holder;

a pad having a pad face that opposes the hold face of the pilot holder;

a movable member having a stop face that opposes the positioning pin and a relief hole for avoiding the tapered tip of the positioning pin from hitting the stop face, the movable member resiliently supported on the pad so that the movable member is vertically movable;

the pilot holder and the pad in which the thin plate material is set between the hold face and the pad face relatively moving to insert the tapered tip of the positioning pin into the positioning hole of the thin plate material to be engaged with the tapered tip at the position of the relief hole, thereby positioning the thin plate material in an in-plane direction; and the stop face of the movable member being flush with or protruding from the pad face of the pad.

2. The positioning apparatus of claim 1, wherein the stop face of the movable member protrudes from the pad face of the pad by a distance greater than zero and smaller than 90 μm.

3. A pressing apparatus employing the positioning apparatus of claim 1, comprising:

an upper mold on which one of the pilot holder and pad is arranged; and a lower mold on which the other of the pilot holder and pad is arranged.

4. The pressing apparatus of claim 3, wherein the thin plate material includes a frame and plural half-finished load beams of head suspensions that are chained together with the frame, the frame has positioning holes for the half-finished load beams, and the positioning pin is inserted into a corresponding one of the positioning holes to position a corresponding one of the half-finished load beams in an in-plane direction and a dimple is pressed in the corresponding half-finished load beam, the dimple being a part that comes in contact with a slider of the head suspension.

* * * * *